US008959674B2

(12) United States Patent
Gellert

(10) Patent No.: US 8,959,674 B2
(45) Date of Patent: Feb. 24, 2015

(54) DRAIN VALVE ASSEMBLY

(76) Inventor: Jimmi Gellert, Frederiksberg C (DK)

( * ) Notice: Subject to any disclaimer, the term of this patent is extended or adjusted under 35 U.S.C. 154(b) by 746 days.

(21) Appl. No.: 13/144,775

(22) PCT Filed: Jan. 15, 2010

(86) PCT No.: PCT/DK2010/050006

§ 371 (c)(1),
(2), (4) Date: Aug. 25, 2011

(87) PCT Pub. No.: WO2010/081479

PCT Pub. Date: Jul. 22, 2010

(65) Prior Publication Data

US 2011/0297865 A1 Dec. 8, 2011

(30) Foreign Application Priority Data

Jan. 16, 2009 (DK) ..... 2009 00064

(51) Int. Cl.
*E03C 1/23* (2006.01)

(52) U.S. Cl.
CPC ..... *E03C 1/23* (2013.01); *E03C 1/2302* (2013.01)
USPC ..... 4/688

(58) Field of Classification Search
CPC ..... E03C 1/2302; E03C 1/2306; A47K 1/14
USPC ..... 4/688–692, 287, 293–295
See application file for complete search history.

(56) References Cited

U.S. PATENT DOCUMENTS

| | | | | |
|---|---|---|---|---|
| 2,697,840 | A * | 12/1954 | Steele | 4/690 |
| 3,314,085 | A | 4/1967 | Minella et al. | 4/689 |
| 6,513,549 | B2 * | 2/2003 | Chen | 138/89 |
| 6,687,926 | B1 | 2/2004 | Bayley | 4/681 |

FOREIGN PATENT DOCUMENTS

| | | | |
|---|---|---|---|
| DE | 102004036652 A1 | 2/2005 | A47K 3/40 |

OTHER PUBLICATIONS

International Searching Authority dated Sep. 27, 2010, pertaining to Application No. PCT/DK2010/050006, 12 pages.

* cited by examiner

*Primary Examiner* — Janie Christiansen
(74) *Attorney, Agent, or Firm* — Sunstein Kann Murphy & Timbers LLP

(57) ABSTRACT

The present invention concerns a drain valve assembly with a pop-up drain stopper for a drain opening. The drain valve assembly has an improved sealing mechanism whereby the drain valve assembly may be easily installed and, in addition, the interface between the drain valve assembly and the drain opening may be easily cleaned.

11 Claims, 4 Drawing Sheets

DRAIN VALVE ASSEMBLY

FIELD OF INVENTION

The present invention relates to a drain valve assembly, e.g. with a pop-up drain stopper for a drain opening.

BACKGROUND OF INVENTION

Today, a traditional drain valve assembly is mounted in the drain of a sink using a top pipe with an annular collar flange and a main drain pipe, connected by screw thread to each other and connected to the sink by applying the collar flange of the top pipe to the top side of the sink as the collar flange has a larger diameter than the drain opening. The interface between the flange and the sink has to be sealed with a sealant or a putty to secure that the interface is water-proof. Beneath the sink, the main drain pipe is connected to the top pipe through the drain of the sink. The interface between a flange of the main drain pipe and the underside of the sink also has to be sealed to secure that the interface is water-proof.

However, the interface between the annular collar flange of the top pipe and the top side of the sink is difficult to seal completely, and further, this interface is difficult to clean. Deposits, such as dirt, are continuously accumulating at this interface. Further, it is difficult to install traditional pop-up drain valve assemblies, because a pivoting lever has to be installed parallel to the front of the sink and adjustments are often needed to correct the installation of the pivoting lever.

SUMMARY OF INVENTION

To overcome the mentioned difficulties, it is an object of the invention to provide a drain valve assembly for a drain opening with an improved sealing mechanism.

The object is achieved by a drain valve assembly for a drain opening, said assembly comprising an upper member having a tubular body with an externally threaded portion and an annular flange having a lower sealing surface, a lower member having a tubular body comprising an internally threaded portion for engagement with the upper member and an annular upper surface for axially positioning the lower member relative to the upper member, and an annular resilient sealing member, such as a circular elastomeric sealing member, e.g. an O-ring, for sealing between the drain valve assembly and the drain opening, characterized in that the annular resilient sealing member is provided between said lower sealing surface of the upper member and the annular upper surface of the lower member such that the annular resilient sealing member is adapted to be expanded in diameter and thereby pressed towards sides of the drain opening for sealing engagement when the surfaces are brought together by the engagement of the threaded portions of the upper and lower members.

In one embodiment of the drain valve assembly, the lower sealing surface of the flange of the upper member and/or the annular upper surface of the lower member is/are provided with conical outwardly inclining surfaces so that the annular resilient sealing member is adapted to be expanded in diameter and thereby pressed towards sides of the drain opening for sealing engagement when the upper surface and lower surface are brought together by the engagement of the threaded portions of the upper and lower members.

In a related embodiment, the lower sealing surface of the flange of the upper member and/or the annular upper surface of the lower member is/are provided with conical outwardly inclining surfaces and the annular resilient sealing member is provided between said lower sealing surface of the upper member and the annular upper surface of the lower member such that the annular resilient sealing member is adapted to be expanded in diameter and thereby pressed towards sides of the drain opening for sealing engagement when the surfaces are brought together by the engagement of the threaded portions of the upper and lower members.

In another embodiment of the drain valve assembly, the annular resilient sealing member is provided with at least one conical inwardly inclining surface so that the annular resilient sealing member is adapted to be expanded in diameter and thereby pressed towards sides of the drain opening for sealing engagement when the upper surface and lower surface are brought together by the engagement of the threaded portions of the upper and lower members. For instance, the annular resilient sealing member may be provided with two conical inwardly inclining surfaces, which may be referred to as a biconical sealing member. Such a resilient sealing member may provide better seals and may cover a larger range of diameters compared to standard O-rings.

In a preferred embodiment of the drain valve assembly, the drain opening has an inner first diameter, the annular flange of the upper member has an outer second diameter and the annular upper surface of the lower member has an outer third diameter, wherein the first diameter is larger than the second diameter and the third diameter.

In a second preferred embodiment of the drain valve assembly, the drain valve assembly comprises a pop-up drain stopper. The pop-up drain stopper may comprise an annular resilient sealing member, such as an O-ring, to prevent leakage when the drain is closed.

In another preferred embodiment of the drain valve assembly, the lower member comprises a main drain member having a tubular body, by which the drain valve assembly may be connected to a larger drain system. The lower member and the main drain member may be in one piece or the lower member and the main drain member may be connected by a connection means, such as a threaded engagement. The main drain member may support an annular resilient sealing member, such as a rubber gasket to seal the interface between the main drain valve and the underside of the object having the drain opening. Further, in one embodiment, the main drain member comprises an extending nipple whereby a pivoting lever may be used to open or close the pop-up drain stopper.

In another preferred embodiment of the drain valve assembly, threaded engagement is used for connecting the upper member to the lower member, and the lower member to the main drain member. Threaded engagement is often used for connecting pipes, although other connection means, such as snapping, are possible. In this embodiment, the upper member and/or the lower member may comprise at least one externally threaded portion and/or at least one internally threaded portion.

In another preferred embodiment, the drain valve assembly comprises guiding members, whereby the pop-up drain stopper may be adapted to move along a substantially straight path, preferably parallel to the axis of the drain opening. In this embodiment, the guiding members may extend the upper member and/or the lower member. In a further preferred embodiment, the guiding members comprise one or more bars, perpendicular to the axis of drain opening, with holes for guiding a bar extending the drain stopper.

BRIEF DESCRIPTION OF THE DRAWINGS

The invention is disclosed in more detail with reference to the accompanying drawings, in which.

DETAILED DESCRIPTION OF THE DRAWINGS

Figure 1:
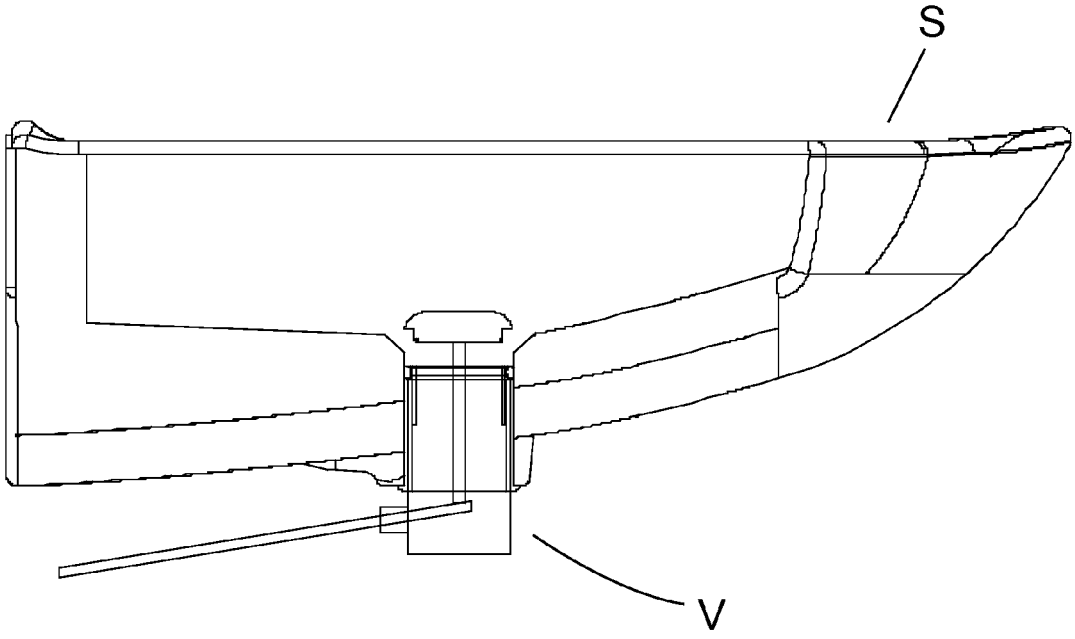
FIG. 1 is a cross section view of the drain valve assembly installed in a sink according to a preferred embodiment of the invention.
Figure 2:
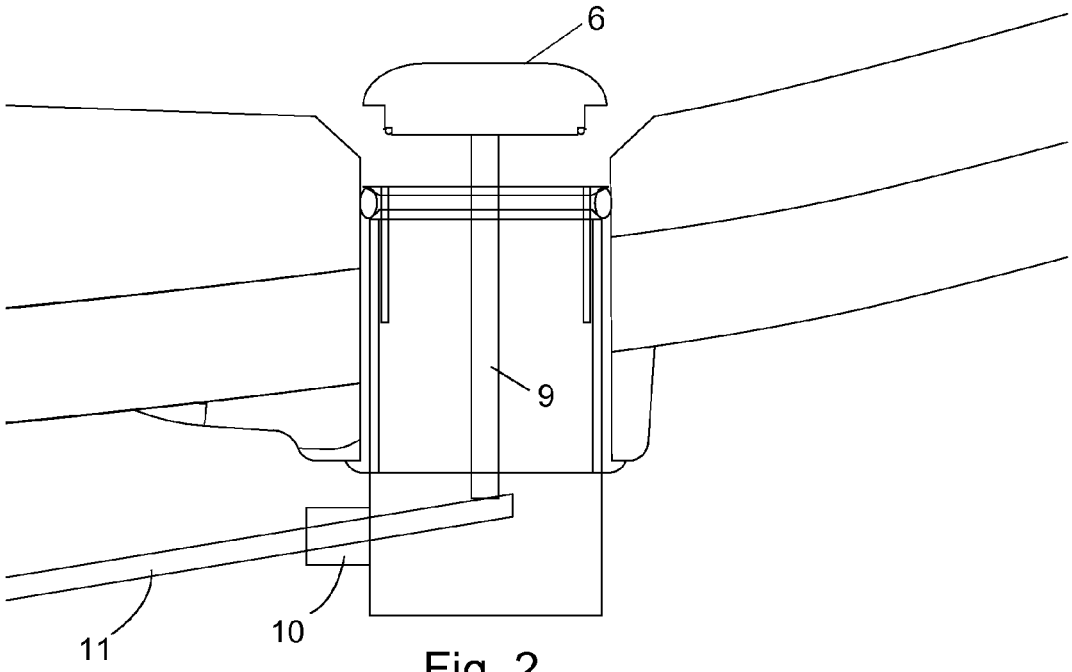
FIG. 2 is a close up cross section view of the drain valve assembly in FIG. 1.
Figure 3:
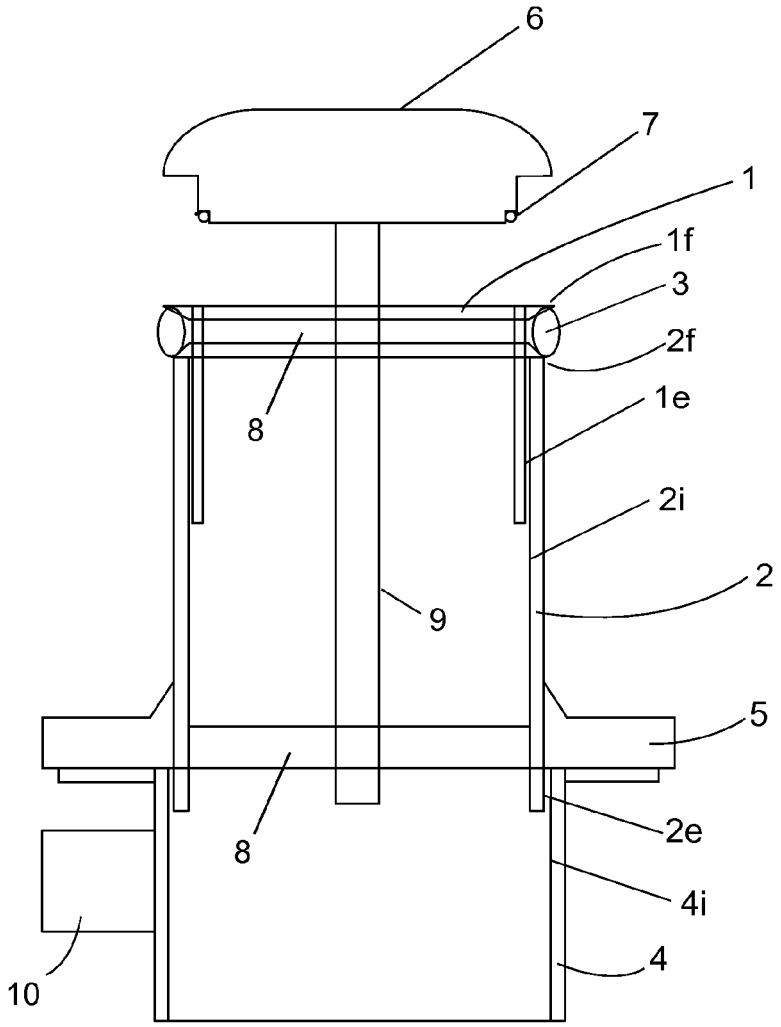
FIG. 3 is a further close up cross section view of the drain valve assembly.
Figure 4:
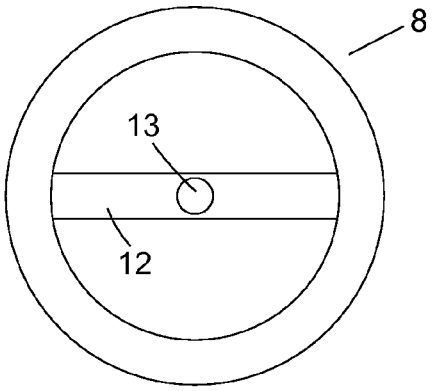
FIG. 4 is a top view of one embodiment of a guiding member.
Figure 5:
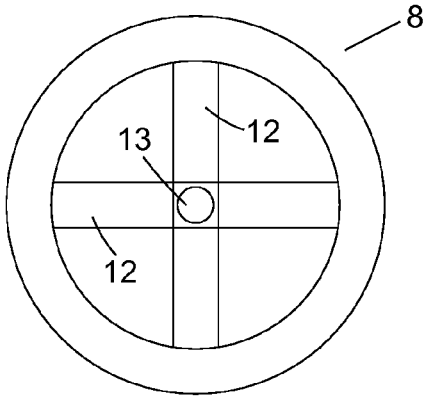
FIG. 5 is a top view of a second embodiment of a guiding member.

A skilled person would appreciate that for clarity purposes; in different figures, same numerals are used to indicate the same component in the apparatus With reference to FIG. 1-5, the drain valve assembly V is installed in a sink S. The drain valve assembly has an upper member 1 having a tubular body with an annular flange having a lower sealing surface 1*f*, which is conical outwardly inclined and an externally threaded portion 1*e* for engagement with a lower member 2 having a tubular body with an annular upper surface 2*f*, which is conical outwardly inclined, an internally threaded portion 2*i*, and an externally threaded portion 2*e*. An annular resilient sealing member, such as an O-ring 3, for sealing between the drain valve assembly and the drain opening, is provided between the lower sealing surface 1*f* of the upper member and the annular upper surface 2*f* of the lower member. The lower member 2 is adapted for engagement with a main drain member 4 which has an internally threaded portion 4*i*. The main drain member supports a rubber gasket 5. A drain stopper 6 extends a bar 9, which is guided through guiding members 8, whereby the drain stopper may close or open the drain by movement of a pivoting lever 11, which is arranged to move through an extending nipple 10 of the main drain member. An O-ring 7 is provided with the drain stopper to prevent leakage when the drain is closed. In one embodiment of the guiding members 8, the bar 9 is guided by a hole 13 in one or more bars 12 perpendicular to the bar 9.

Figure 6:
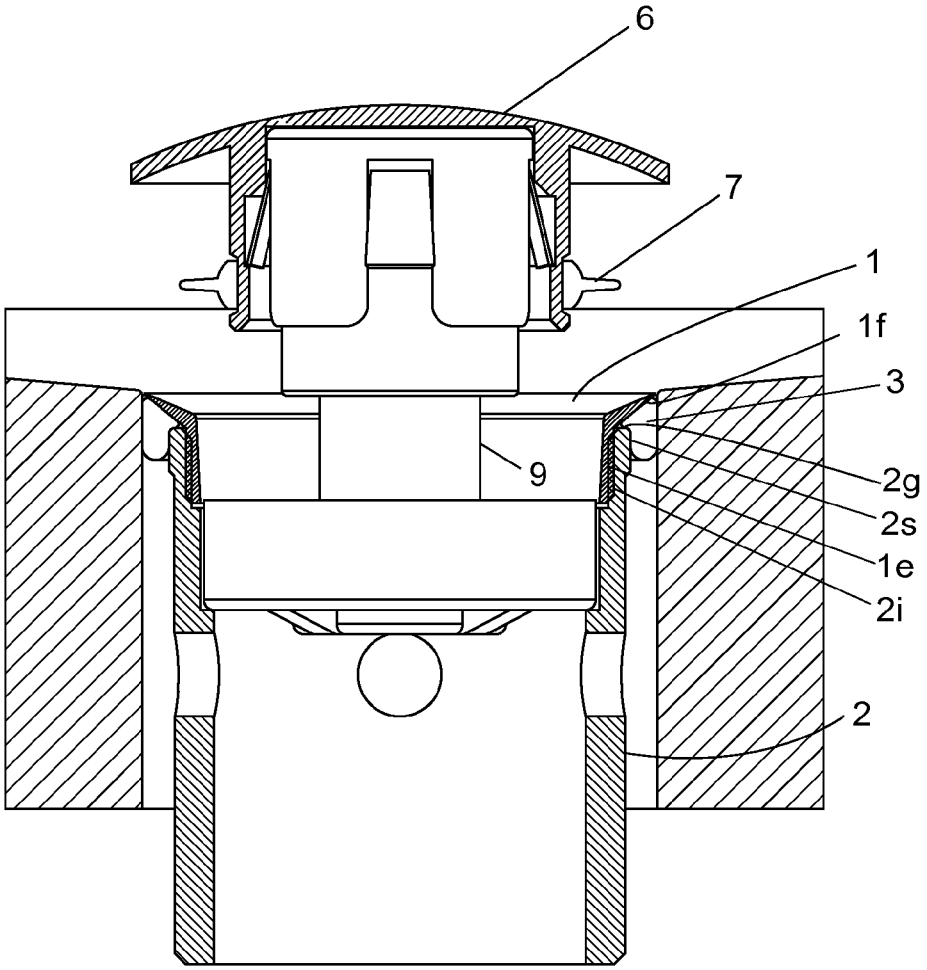
FIG. 6 is a close up cross section view the drain valve assembly according to another embodiment.

With reference to FIG. 6, the drain valve assembly according to another preferred embodiment is mounted in a drain opening. In this embodiment, the drain valve assembly has an upper member 1 having a tubular body with an annular flange having a lower sealing surface 1*f*, which is conical outwardly inclined and an externally threaded portion 1*e* for engagement with a lower member 2 having a tubular body with an annular upper surface 2*g*, which extends radially from the lower member 2 so that the surface 2*g* substantially lies in a plane that is perpendicular to the rotation axis of the tubular body, and said lower member 2 having an internally threaded portion 2*i*. An annular resilient sealing member, such as an O-ring 3, for sealing between the drain valve assembly and the drain opening, is provided between the lower sealing surface 1*f* of the upper member and the lower member 2. The lower member may, in addition to the upper surface 2*g*, comprise a side or corner portion 2*s* that is adapted to support the annular resilient sealing member, for instance by friction forces.

Figure 7:
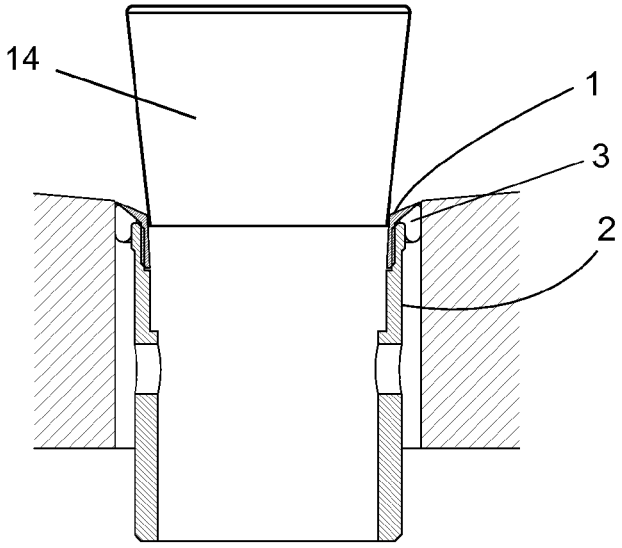
FIG. 7 is a cross section view of the drain valve assembly in FIG. 6 with a tool for arranging the drain valve assembly in a sink.
Figure 8:
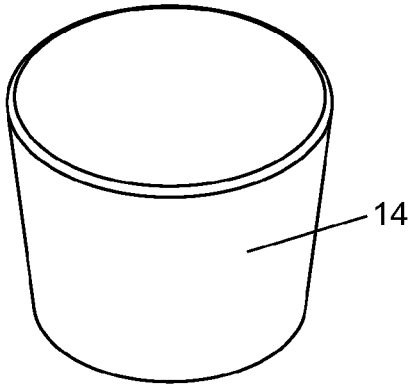
FIG. 8 is a perspective view of the tool in FIG. 7, FIG. 9, 10 are exploded views of the drain valve assembly in FIG. 6.

With reference to FIGS. 7 and 8, the drain valve assembly having an upper member 1, a lower member 2, and an annular resilient sealing member 3 is shown with a tool 14 for arranging the drain valve assembly in a drain opening. The tool 14 has an annular conical shape adapted to fit in the opening of the upper member 1 and is preferably made of a resilient material. The operator may insert the tool 14 into the opening of the upper member 1 so that the tool is attached to the upper member 1 by friction forces and the tool may thereafter be used for turning the upper member 1 in order to expand the annular resilient sealing member 3 in diameter and thereby pressing the annular resilient sealing member 3 towards sides of the drain opening for sealing engagement. In a related embodiment, the upper member 1 is provided with tool receiving means, such as notches, grooves or openings. The upper member 1 may thus be adapted for engagement with a suitable tool in order to bring the upper surface and the lower surface together.

Figure 9:
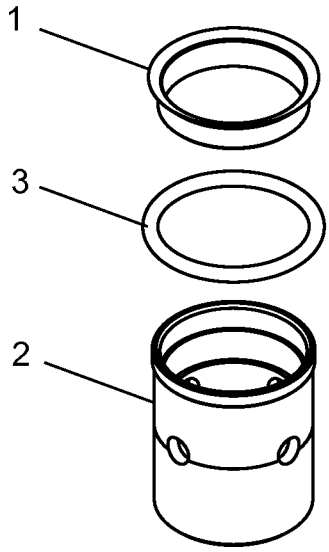
Figure 10:
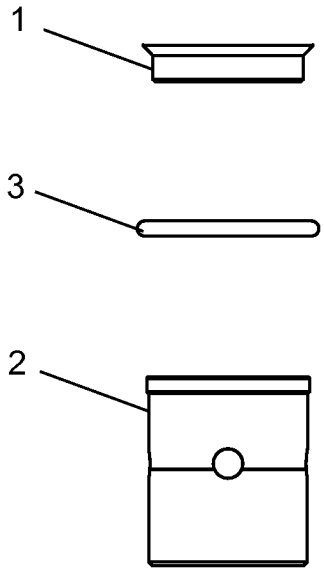
Figure 11:
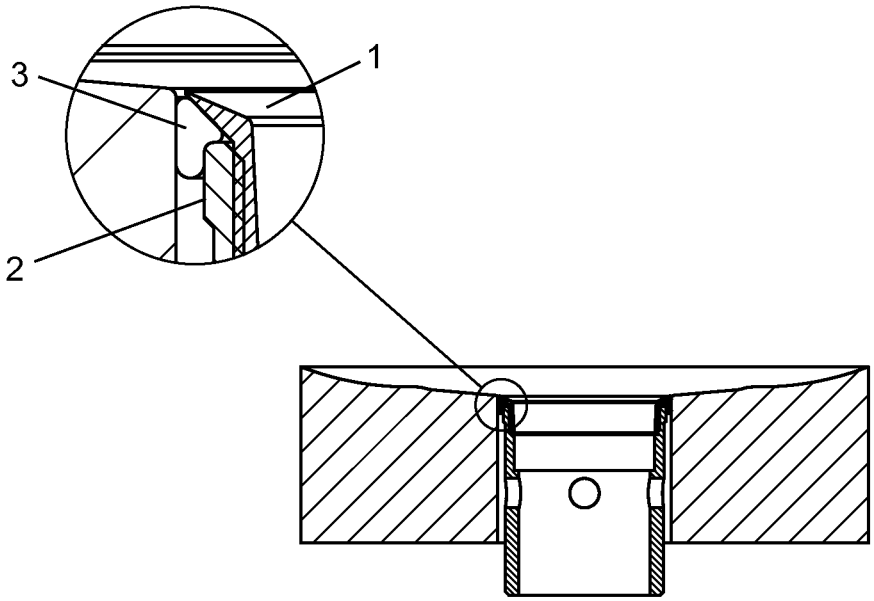
FIG. 11 is cross section side view of the drain valve assembly in FIG. 6 installed in a sink.

With reference to FIG. 9-11, there are shown exploded views of the drain valve assembly having an upper member 1, a lower member 2, and an annular resilient sealing member 3. The drain valve assembly is constructed so that various versions of the upper members 1 having different annular flanges with various diameters and associated sealing members 3 with various diameters can engage with identical lower members 2. This is advantageous in that the various versions of upper members 1 and sealing members 3 may be provided with identical lower members 2 according to drain openings with different diameters, typically varying from 43 to 48 mm.

EXAMPLE

In one embodiment, the drain valve assembly may be mounted in a sink by carrying out the following steps.

1. The upper member 1 and the lower member 2 are screwed loosely against the O-ring 3.
2. The main drain member 4 is screwed together with the lower member 2 with a rubber gasket 5 in between, by which a unit is formed of the upper member 1, the lower member 2, the O-ring 3, main drain member 4, and the rubber gasket 5.
3. The unit described in step 2 is pushed up into the drain opening from beneath the sink. The main drain member 4 is screwed one quarter turn from its final position.
4. From the top side of the sink, the upper member 1 and the lower member 2 are fastened against the O-ring 3, whereby the O-ring 3 is expanded in diameter and thereby pressed towards sides of the drain opening for sealing engagement when the surfaces are brought together by the engagement of the threaded portions of the upper and lower members. The O-ring 3 is now fixed in position and the interface between the O-ring 3 and the drain opening is water-proof.
5. The main drain member 4 is screwed one quarter turn to reach its final position, where it is pressing the rubber gasket 5 towards the underside of the sink.
6. The drain stopper 6, with a fixed O-ring 7, is mounted into the drain valve assembly from the top side of the sink.

In the description of the invention above, the terms 'upper' and 'lower' have been used only to illustrate the relative arrangement of elements of the invention, and it is realised that embodiments of the invention may be provided, wherein the invention is rotated in any angle, i.e. not limited to the terms 'upper' and 'lower' used above.

While specific and preferred embodiments of the invention have been shown and described in detail above to illustrate the inventive principles, it will be understood that variants to these embodiments may be provided without departing from the scope of the invention as set forth in the accompanying claims.

The invention claimed is:

1. A drain valve assembly for a drain opening, the drain opening having an inside wall defining an aperture having a drain aperture inside diameter, said assembly comprising:

an upper member having a tubular body with an externally threaded portion and an annular flange having a lower sealing surface, the annular flange having a flange outside diameter smaller than the drain aperture inside diameter;

a lower member having a tubular body comprising an internally threaded portion for threaded engagement with the externally threaded portion of the upper member, the lower member further comprising an annular upper surface for axially positioning the lower member relative to the upper member, the annular upper surface having an outside surface diameter smaller than the drain aperture inside diameter; and an annular resilient sealing member for sealing between the drain valve assembly and the drain opening; wherein:

the annular resilient sealing member is provided between said lower sealing surface of the upper member and the annular upper surface of the lower member such that the annular resilient sealing member is adapted to be expanded in outside diameter and thereby pressed towards the inside wall of the drain opening for sealing engagement when the surfaces are brought together by the engagement of the threaded portions of the upper and lower members; and the upper member and the lower member are configured such that, when the externally threaded portion of the upper member is threadedly engaged with the internally threaded portion of the lower member, the tubular body of the upper member and the tubular body of the lower member collectively define a fluid channel through the drain valve assembly.

2. A drain valve assembly according to claim 1, wherein at least one of said lower sealing surface of the flange of the upper member and the annular upper surface of the lower member is provided with a conical outwardly inclining surface that the annular resilient sealing member is expanded in diameter and thereby pressed towards sides of the drain opening for sealing engagement when the upper surface and lower surface are brought together by the engagement of the threaded portions of the upper and lower members.

3. A drain valve assembly according to claim 1, wherein the annular resilient sealing member is provided with at least one conical inwardly inclining surface and the annular resilient sealing member is configured to expand in diameter and thereby press towards sides of the drain opening for sealing engagement when the upper surface and lower surface are brought together by the engagement of the threaded portions of the upper and lower members.

4. The drain valve assembly according to claim 1, further comprising a pop-up drain stopper.

5. The drain valve assembly according to claim 4, wherein the pop-up drain stopper comprises an annular resilient sealing member.

6. The drain valve assembly according to claim 1, wherein the lower member comprises a main drain member having a tubular body.

7. The drain valve assembly according to claim 6, wherein the main drain member comprises an extending nipple.

8. The drain valve assembly according claim 1, wherein at least one of the upper member and the lower member comprises at least one of an externally threaded portion and an internally threaded portion.

9. The drain valve assembly according to claim 1, further comprising at least one of a guiding member and a pivoting lever.

10. A drain valve assembly according to claim 1, wherein the annular resilient sealing member comprises an O-ring.

11. The drain valve assembly according to claim 6, wherein the main drain member is configured to support an annular resilient sealing member.

* * * * *